US005997361A

United States Patent [19]

Driscoll et al.

[11] Patent Number: 5,997,361

[45] **Date of Patent: *Dec. 7, 1999**

[54] ELECTRONIC CABLE CONNECTOR

[75] Inventors: Michael P. Driscoll, Deep River; Michael N. Perugini, Monroe, both of Conn.; Charles A. Toye, Jr., Longmeadow, Mass.; William R. Keller, Litchfield, Conn.; Carmine Gugliotti, Waterbury, Conn.; Robert M. Bradley, Oakville, Conn.

[73] Assignee: Litton Systems, Inc., Watertown, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/885,713

[22] Filed: Jun. 30, 1997

[51] Int. Cl.[6] ..... H01R 13/502

[52] U.S. Cl. ..... 439/701; 439/607; 439/358; 439/95

[58] Field of Search ..... 439/700, 701, 439/607–610, 108, 677, 680

[56] References Cited

U.S. PATENT DOCUMENTS

| | | | |
|---|---|---|---|
| 4,506,949 | 3/1985 | Knop | 350/162.19 |
| 4,773,881 | 9/1988 | Adams, III | 439/681 |
| 4,984,992 | 1/1991 | Beamenderfer et al. | 439/108 |
| 5,066,236 | 11/1991 | Broeksteeg | 439/79 |
| 5,236,375 | 8/1993 | Kachlic | 439/701 |
| 5,312,276 | 5/1994 | Hnatuck et al. | 439/701 |
| 5,368,505 | 11/1994 | Hoolhurst et al. | 439/701 |
| 5,387,130 | 2/1995 | Fedder et al. | 439/607 |
| 5,525,066 | 6/1996 | Morlion et al. | 439/108 |
| 5,554,038 | 9/1996 | Morlion et al. | 439/108 |
| 5,573,416 | 11/1996 | Morlion et al. | 439/108 |
| 5,588,851 | 12/1996 | Morlion et al. | 439/108 |
| 5,697,805 | 12/1997 | Orstad et al. | 439/374 |
| 5,702,258 | 12/1997 | Provencher et al. | 439/79 |
| 5,766,023 | 6/1998 | Nosehese et al. | 439/74 |

FOREIGN PATENT DOCUMENTS

| | | |
|---|---|---|
| 0649195A1 | 4/1994 | European Pat. Off. . |
| 0682387A1 | 3/1995 | European Pat. Off. . |
| 0801447A1 | 3/1997 | European Pat. Off. . |
| WO 96/00917 | 11/1996 | WIPO . |

OTHER PUBLICATIONS

"MetCon–Cable", Litton Winchester Electronics, pp. 1–15.

"Millipac 2™ 22MM Packagin System For Low and High Frequency Applications", Framatone Connectors International, pp. 1–74.

*Primary Examiner*—Hien Vu

*Attorney, Agent, or Firm*—Michael H. Wallach; Kenneth M. Berner

[57] ABSTRACT

An electrical cable connector is disclosed for connecting a plurality of electrical conductors to a printed circuit board. The cable connector includes a cable socket connector having a plurality of female insulation displacement contacts which can be mated with male signal-carrying pins contained in a pin shroud on a printed circuit board. The cable socket connector is comprised of a hood which retains two or more wafers. Each wafer contains a plurality of insulation displacement contacts. The cable socket connector may include a latch for securing the cable socket connector to the pin shroud and shielding to prevent extraneous signals from being transmitted into the circuits on the printed circuit board through the cable connector. The cable connector also includes an arrangement for keying the cable socket connector to the pin shroud to control the location of insertion of the cable socket connector into the pin shroud.

18 Claims, 7 Drawing Sheets

ELECTRONIC CABLE CONNECTOR

BACKGROUND OF THE INVENTION

1. Field of the Invention

This invention relates to electrical connectors in general, and, in particular, to a cable connector which permits an electrical cable having multiple conductors to be removably connected to electrical circuits on a printed circuit board or back panel.

2. Summary of the Prior Art

Electronic circuits for many applications including, for example, for telecommunications applications, are becoming increasingly faster and more complex with a need to accommodate many electrical circuits and components on printed circuit boards or back panels. It is frequently necessary in complex systems to interconnect circuits contained on back panels to circuits in other locations, for example by using multi-wire electrical cabling. As electronic circuits increasingly become more complex and faster in operation, their sensitivity to radio frequency interference and other electromagnetic radiation increases. Consequently, there is a need to protect the interconnections between back panels and other components which are connected by cable from stray electromagnetic interference and other forms of interferences (sometimes referred to as "EMI-RFI" interference). Electrical cables connecting electronic circuits in other locations to back panels are frequently isolated from cross-talk by encasing the signal conductors in a conductive shield. Since it is advantageous to connect a multi-wire electrical cable to a back panel with a connector which can be readily disconnected without breaking solder joints, it would also be advantageous to have shielding on the electrical connector to avoid introducing cross-talk into the signal carrying conductors through the unshielded connector. This arrangement would be particularly useful where a cable connector is connected to signal carrying pins which are installed in a pin field on a back panel, since failure to properly insulate the pin field from stray electromagnetic signals may result in the pins acting as antennae with the attendant degradation of signals being transmitted between the cable and circuits on the back panel. In addition, it would also be advantageous to have an electrical connector which provides grounding between the conductive surfaces on the cable-end of the connector and ground planes contained on the back panel.

Use of metal shielding to shield connectors from stray electromagnetic radiation is known in the prior art. However, metal shielding is bulky and is frequently difficult to accommodate in high density connectors, that is, in connectors having a substantial number of contacts in a confined space. In addition to having the contacts in a connector electrically isolated from stray electromagnetic radiation, it would be also advantageous to shield adjacent pins and pin contacts from both stray electromagnetic radiation and cross-talk produced by the transmission of signals from one wire in a multi-wire cable into adjacent contacts through the electrical connector.

One form of cable connector for use in effecting contact between multi-wire cables and circuits on printed circuit boards is manufactured by Harting Electronik of Germany and is sold under the trademark "Har-Pak". While the system is modular and permits making high density contacts between cables and circuits on printed circuit boards, there is still a need for a more flexible approach to making interconnections between multi-wire cables and a printed circuit board, including a need for achieving EMI-RFI shielding on both the male and female portions of the connector system.

While there are a variety of electrical connectors available for effecting connections between signal carrying wires in a multi-wire cable and electrical circuits contained on a printed circuit board or back panel, the combination of an electrical connector which includes closely spaced contacts for connecting circuits in a multi-wire cable to a pin field on a back panel and which also provides EMI/RFI shielding to isolate the circuits from stray electromagnetic radiation and which also includes a keying capability to insure that the cable-end of the connector makes electrical contact with the proper pins in a pin field is not known. Furthermore, it would advantageous to have an electrical connector for making connections between a multi-wire cable and a pin field on a back panel which can be configured to permit the number of contacts in the cable-portion of the connector to be designed to accommodate a specific number of pins in a pin field on a back panel. The connector disclosed herein not only permits the quick connection of multiple wires in a cable to circuits on a printed circuit board but also insures that isolation from stray electromagnetic radiation is achieved between the cable-end of the connector and the printed circuits contained on the back panel.

SUMMARY OF THE INVENTION

One object of this invention is to provide an electrical connector which will permit the connection of multiple wires of a cable to electronic circuits contained on a printed circuit board or back plane.

Another object is to provide an electrical connector which permits the connection of a cable containing multiple wires to a printed circuit board to be conveniently and quickly disconnected and reinstalled without using special tools.

Still another object of the invention is to provide a connector for connecting a multi-wire cable to a printed circuit board which utilizes insulation displacement-type contacts which do not have to be soldered to the wires.

Still another object of the invention is to provide a cable connector which can be keyed so that the wires connected to the connector cannot be accidentally connected to improper connections on the printed circuit board.

Still another object of the invention is to provide a cable connector which includes electromagnetic shielding which automatically is connected to the ground plane on a printed circuit board when the connector is connected to the printed circuit board.

The foregoing and other objects and advantages of the invention are achieved by providing a cable connector comprised of a cable socket connector fastened to the cable, and a pin shroud. The pin shroud is fastened to a printed circuit board and includes a field of electrically conducting pins which are connected to circuits on the printed circuit board. The pin shroud includes a base having apertures through which each of the pins pass and vertical walls which contain a plurality of vertical channels. The cable socket connector is comprised of a hood which contains multiple contact-carrying wafers. Each wafer includes a plurality of insulation displacement contacts which can be electrically connected to the conductors in a multi conductor cable. The insulation displacement contacts in each wafer receive pins contained in the pin shroud when the cable socket connector is inserted into the pin shroud. Preferably, the cable socket connector includes a latch which is received by a wall of the pin shroud to positively fasten the cable socket connector to the pin shroud. The cable socket connector also may include keys on a wall of the hood which are located to align with channels on an inner wall of the pin shroud. The combination of the keys and channels permit the cable socket connector to align the contacts in the cable socket connector with the pins in the pin shroud prior to the pins being received by the contacts in the cable socket connector. Means are also disclosed to selectively key the cable socket connector to the pin shroud to control the location in the pin shroud in which the cable socket connector may be inserted.

A preferred embodiment of the invention includes shielding on the pin shroud and the cable socket connector to prevent electromagnetic interference from affecting signals carried by the electrical conductors connected to the printed circuit board. The shielding includes separate shielding on the hood of the cable socket connector and the wafers contained in the cable socket connector and also includes shielding on the pin shroud. Means are disclosed for electrically connecting the shielding on the hood of the cable socket connector and the wafers to the shielding on the pin shroud.

BRIEF DESCRIPTION OF THE DRAWING

The above objects and other advantages of the invention will be appreciated after study of the detailed description of the preferred embodiments when read in conjunction with the drawing in which.

DETAILED DESCRIPTION OF PREFERRED EMBODIMENTS

Figures 1, 1A:
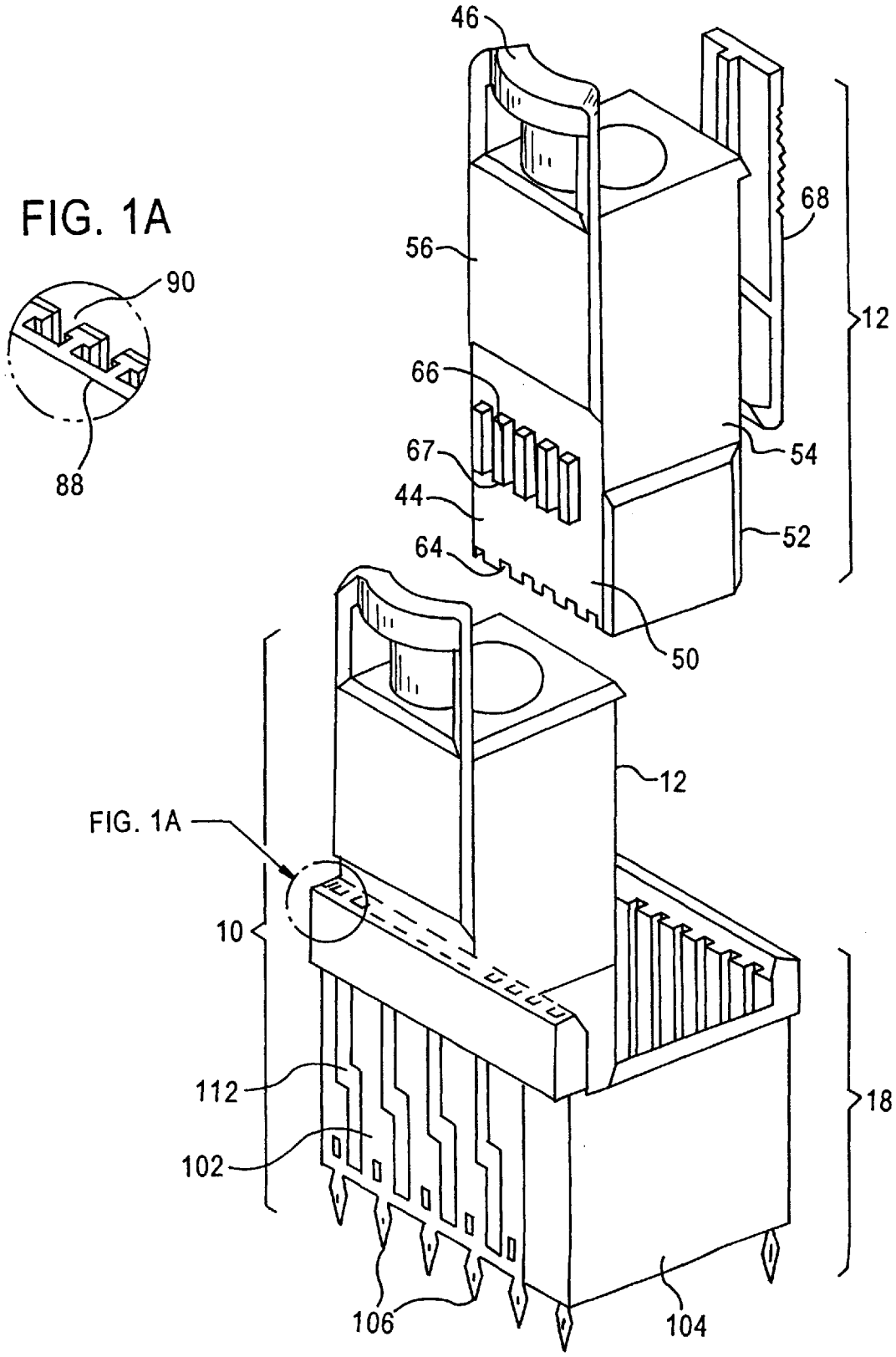
FIG. 1 is an exploded perspective view of a cable connector constructed in accordance with the teachings of the invention.
FIG. 1A is an exploded perspective view of the cable socket connector and pin shroud constructed in accordance with the teachings of the invention.

Referring to the drawing, FIG. 1 shows a cable connector 10 constructed in accordance with the teaching of a preferred embodiment of the invention. The cable connector includes a cable socket connector shown generally at 12 which is adapted to receive a cable 14 (FIG. 2) having multiple electrical conductors 16. The cable socket connector 12 is received within a pin shroud 18. Pin shroud 18 may be fastened to a printed circuit board or back plane 20 (FIG. 3) using multiple pins 21 to effect electrical connections between the conductors 16 and circuits contained on the back plane 20. In one preferred embodiment, multiple cable socket connectors 12 may each be installed in a common pin shroud 18 to permit connections to be made between the conductors 16 of multiple cables 14 and the circuits on a back plane 20.

Figures 4, 4A:
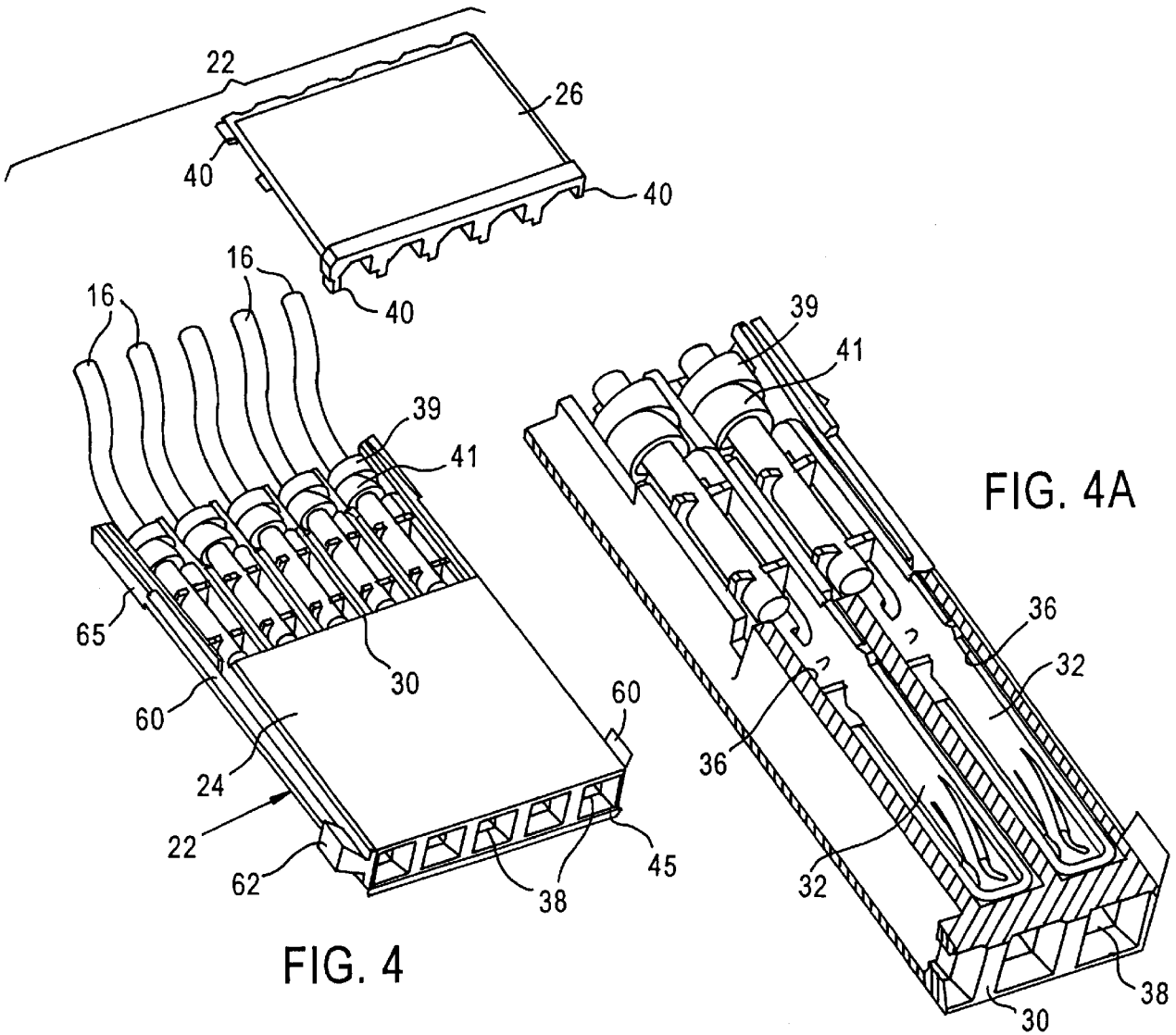
FIG. 4 is an exploded perspective view of a wafer containing multiple insulation displacement contacts.
FIG. 4A is an exploded view showing two contacts installed in a wafer.
Figures 5, 5A:
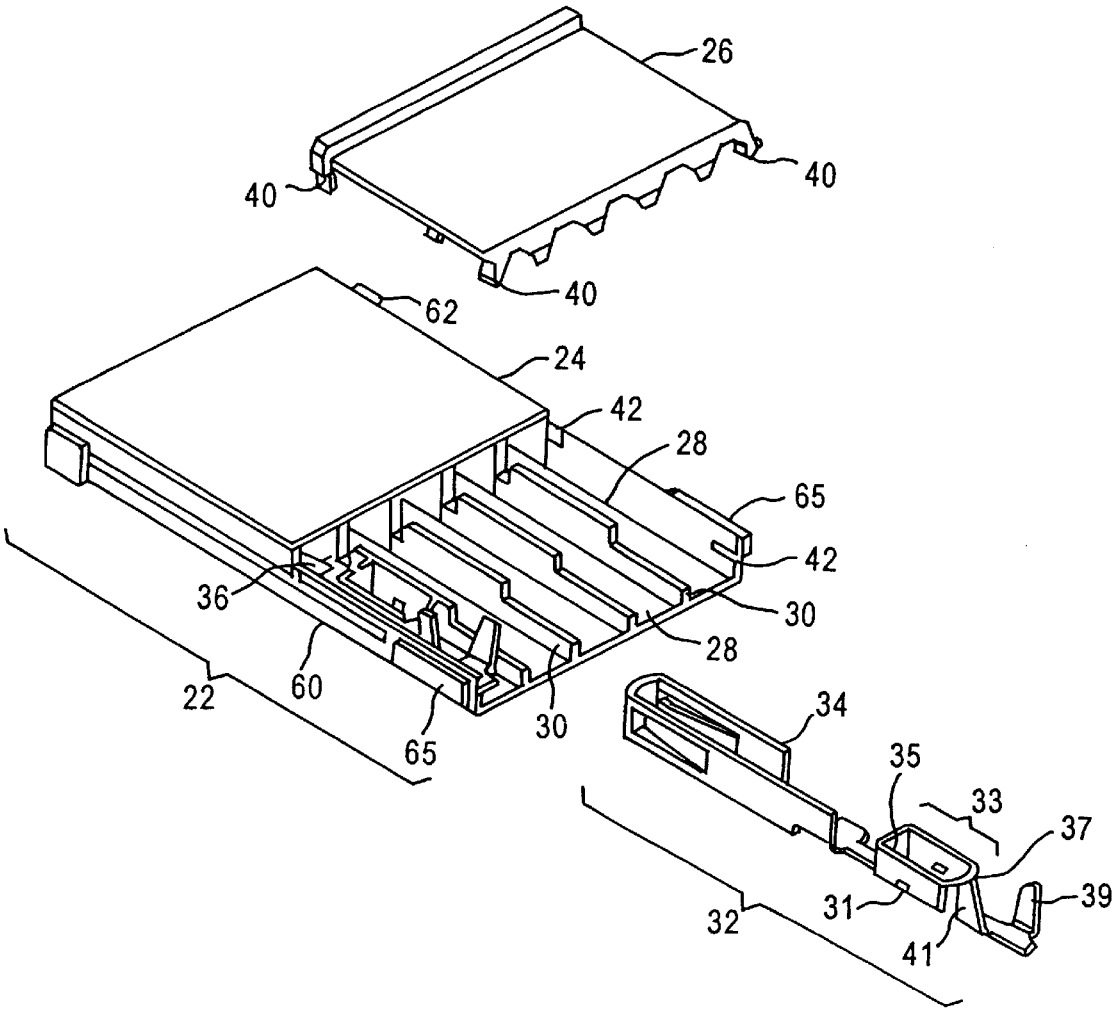
FIG. 5 is a second view of a wafer.
FIG. 5A is a perspective view of an insulation displacement contact which may be used in connection with the cable connector of the invention.

Cable socket connector 12 includes two or more wafers 22 (FIG. 4) each of which may have multiple connectors 16 terminated therein. As is best illustrated in FIG. 5, each wafer 22 includes a body 24 molded from a plastic material, for example from polybutadiene tetrephthalate (PBT), and a wafer cover plate 26 to cover the rearward end of the wafer 22. The cover plate 26 may be made from the same material as the body 24. Advantageously, the wafer cover plate 26 electrically isolates electrical conductors 16 from adjacent wafers preventing an electrical short of the electrical conductor 16 if the wafer is plated with an electrically conductive coating. The wafer cover plate 26 is mechanically fastened to the wafer 22 by a friction fit achieved between the tabs 40 and tab receiving slots 42 contained in the wafer. Preferably the body 24 of each wafer 22 includes multiple apertures 28 each of which are separated from adjacent apertures by walls 30. The apertures 28 receive insulation displacement contacts shown generally at 32. One form of insulation displacement contact which may be used in connection with the subject invention is disclosed in claims in U.S. Design patent application Ser. No. 29/074,680 filed on Jun. 30, 1997 under attorney docket No. WI 96-08, the inventor for which is Robert M. Bradley. Insulation displacement contacts 32 are separated from each other by the walls 30. The forward end 34 of each insulation displacement contact 32 is contained in a channel 36. Each channel 36 has an aperture 38 at the forward end of the wafer 22 to receive the end of the pins 21 which are contained in pin shroud 18. The insulation displacement contact 32 include at least one retainer barb 31 along the body of the contact to retain the contact 32 within channel 36. Additionally, the cover plate 26 includes fingers (not shown) on its underside which further assist in retaining the contact 32 in channel 36 by pressing against the body of the contact 32 when the cover plate 26 is fastened to the wafer 22.

FIG. 5A illustrates that each insulation displacement contact 32 includes a wire receiving section 33 having wire receiving grooves 35 and 37. Grooves 35 and 37 receive an insulated wire and pierce the insulation surrounding the wire in a well known manner. Grooves 35 and 37 include alignment slots which are tapered in a V shape to assist in aligning the wire 16 toward the direction of grooves 35 and 37 as the wire is directed into slots 35 and 37 to be connected to contact 32. Preferably, the contacts 32 also include ears 39 and 41 at the end distant from the pin receiving end 34. Ears 39 and 41 may be crushed around the insulation of a wire 16 to insure that the wire is not mechanically withdrawn from insulation displacement contact 32 due to mechanical strain placed on the wire, for example, when the cable socket connector 12 is withdrawn from pin shroud 18 by pulling on cable 14.

Figure 6:
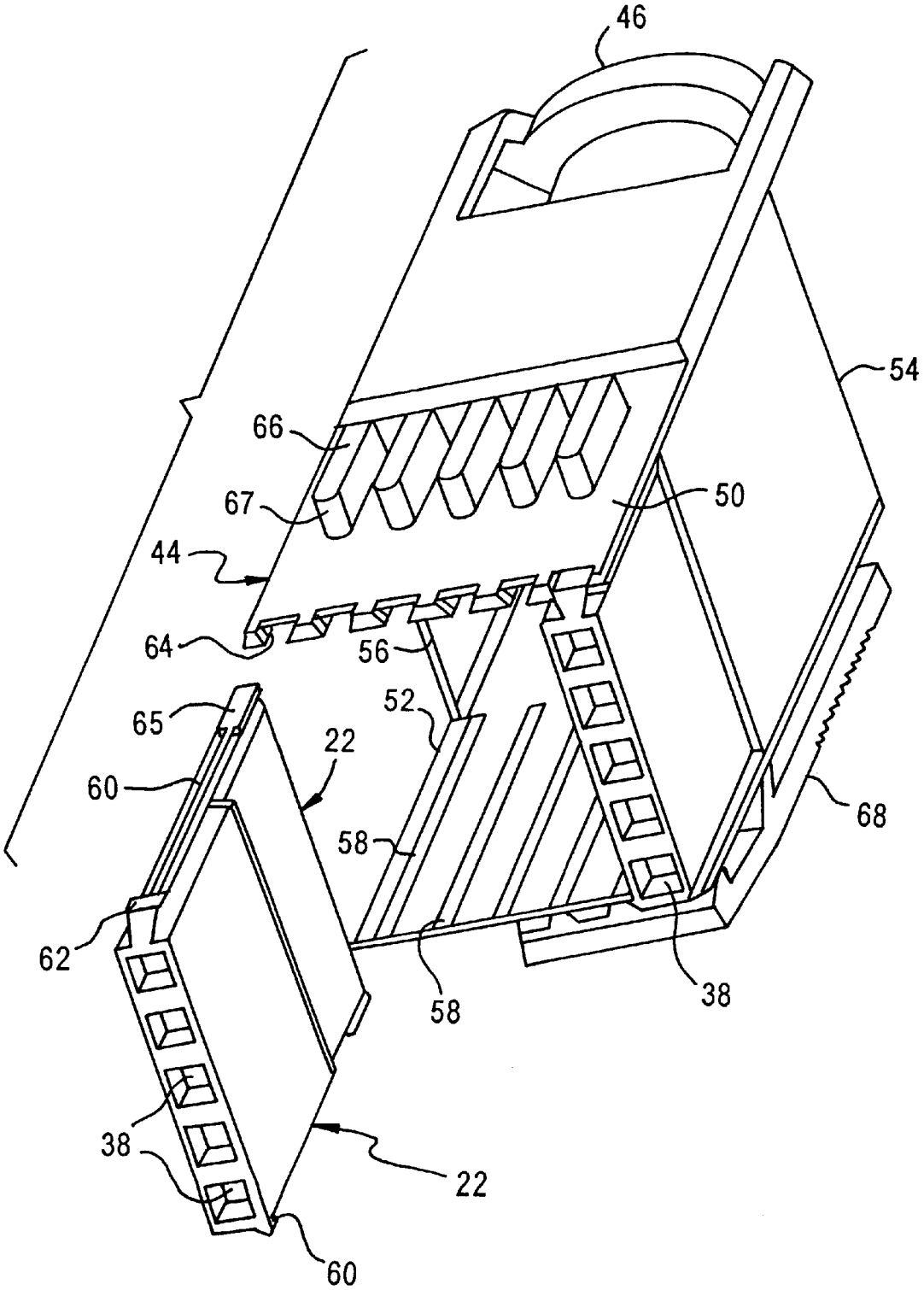
FIG. 6 is an exploded perspective view showing a cable socket connector including a hood and a wafer for installation in the hood.

A hood shown generally at 44 in FIG. 6 is used to fasten multiple wafers 22 together. Preferably, the hood 44 includes cable support 46 which may also include a cable restrainer 48, for example a flexible plastic cable tie which passes through cable support 46 and around the cable 14 to firmly retain the cable to the cable socket connector 12. Hood 44 includes sidewalls 50 and 52 and connecting walls 54 and 56. Preferably walls 50 and 52 each include multiple parallel channels 58 to receive guides 60 which are molded into the sides of each wafer 22. Preferably each guide 60 on each wafer terminates in a keying block 62 at the forward end of the wafer 22 which is received in an aperture 64 formed at the end of each channel 58. Preferably, wall 50 of the hood 44 may also include one or more keys 66 having rounded ends 67 to engage guide rails (later described) in the pin shroud 18. Preferably each wafer 22 includes a tab 65 at the end of wafer 22 distant from the pin receiving apertures 38. Each tab 65 is received in a slot 59 (FIG. 2) in end wall 52 of the hood 44. As is shown in FIG. 6, each wafer 22 is slid into the hood 44 using matching channels 58 and guides 60 to effect placement of the wafer 22 within the hood 44. Preferably, those portions of walls 50 and 52 at the end of hood 44 which receive the wafers 22 upon initial entry of the wafer into the hood 44 are sufficiently flexible to permit a wafer 22 to be slid along channels 58 until the keying blocks 62 engage the apertures at the end of channel 58. Once fully inserted into hood 44, tab 65 of each wafer 22 become engaged within its corresponding slot 59 in wall 52 to lock the wafers 22 into hood 44.

Figure 2:
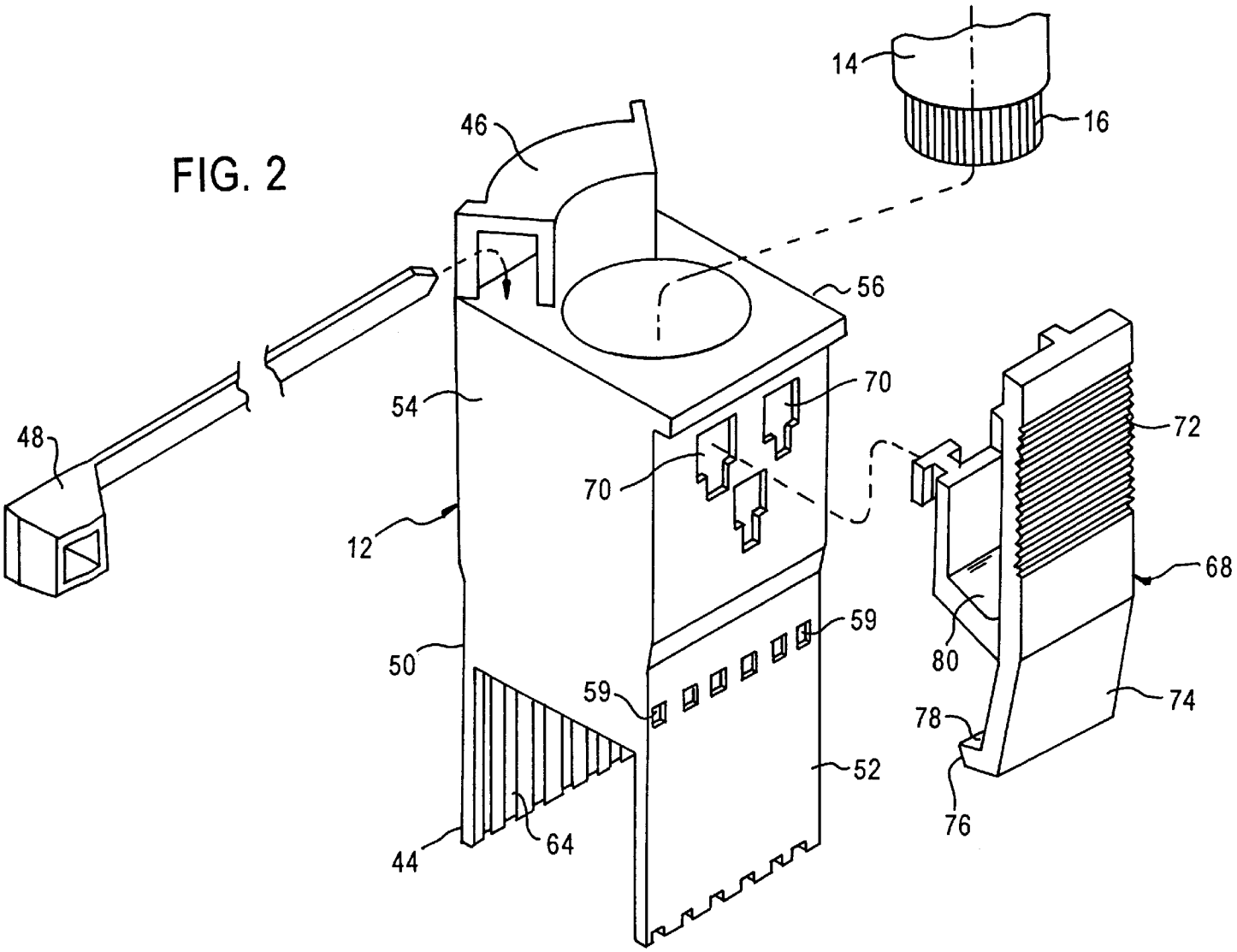
FIG. 2 is a perspective view of a hood and latch of the invention.
Figure 3:
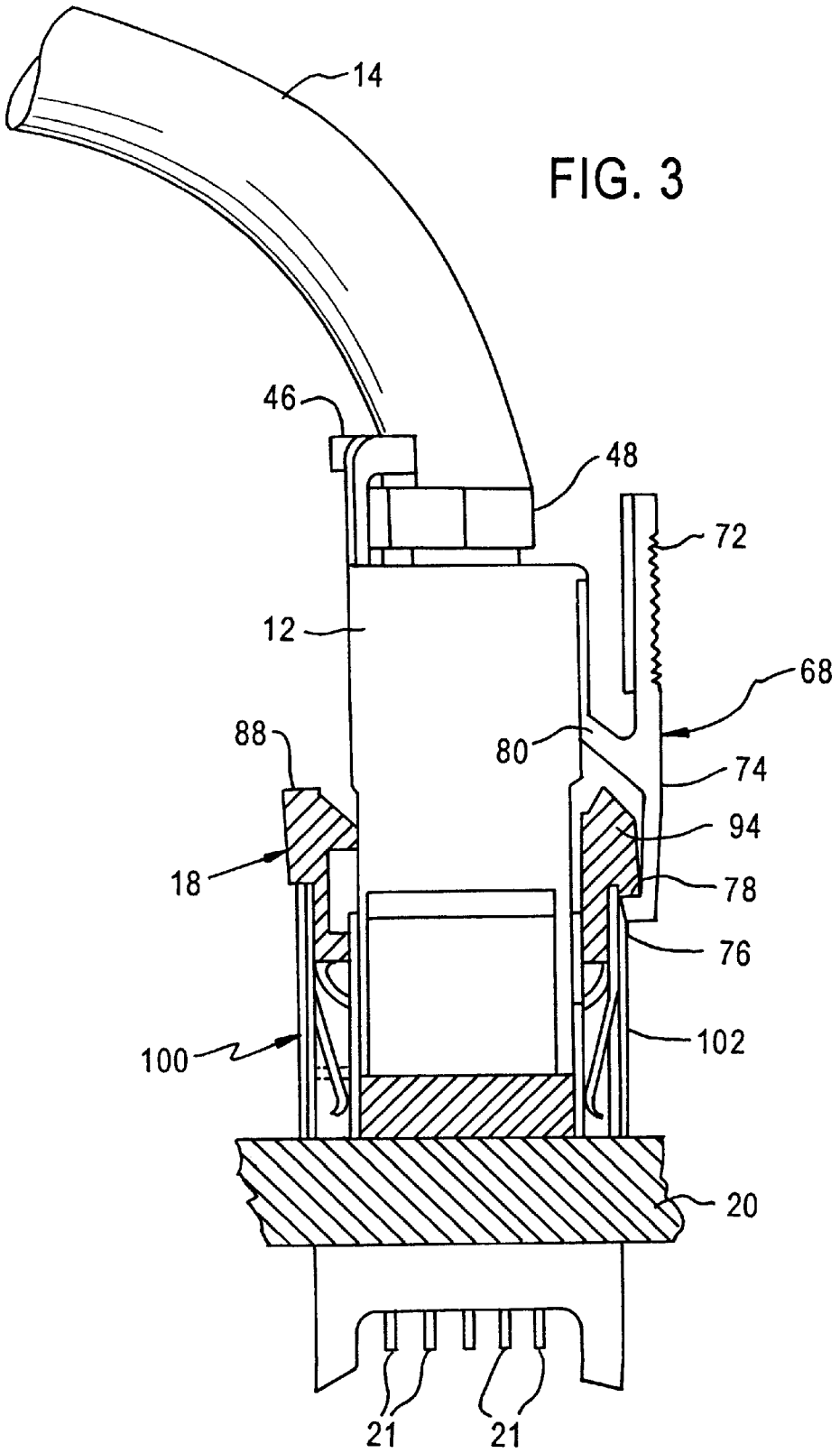
FIG. 3 is a side view of cable socket connector installed in a pin shroud which is fastened to a back plane.
Figure 7:
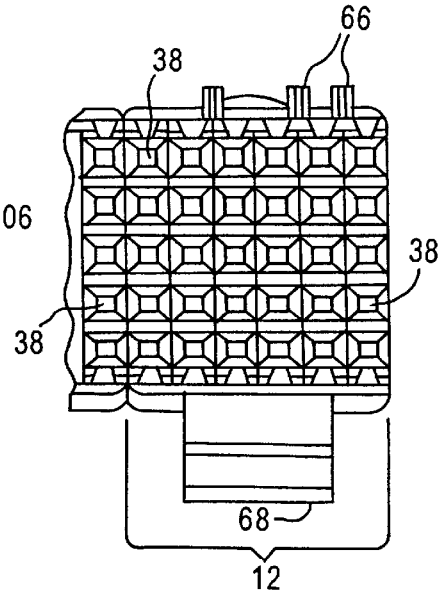
FIG. 7 is an end view of a cable socket connector showing a field of contacts.

FIG. 7 shows a front end view of a hood 44 containing six wafers 22. Each wafer contains five contacts, therefore providing a total of 30 contacts in the cable socket connector 12. Note, that FIG. 2 shows one row (wafer) of an adjacent hood 44, thereby illustrating that multiple cable socket connectors 12 can be placed side by side to effect connections between wires and pins 21 in a pin shroud 18. However, it is also possible to manufacture a cable socket connector 12 with a hood 44 which can accommodate a fewer or greater number of wafers 22. For example, a pin shroud 18 could simultaneously accommodate several (or more) cable socket connectors 12 each having different numbers of wafers to accommodate the number of signal-carrying wires 16 contained in each cable 14 which it is desired to connect to the pin shroud 18.

FIG. 2 shows that a cable socket connector 12 may also include a latch 68 to fasten cable socket connector 12 to pin shroud 18. Latch 68 may be fastened to hood 44 through the keyed guides 70. Preferably latch 68 includes a finger biased portion 72 and a distal latching portion 74 having a sloped guide face 76 and a latch engaging shelf 78. Preferably end 72 of the latch 68 may contain a ribbed or roughened portion to facilitate movement of the latch by light finger pressure. Latch 68 further includes a flexible support portion 80 to effect fixation of the latch 68 to the hood 44 Latch 68 is preferably contained on the side of hood 44 opposite to the side which contains cable support 46 so that when finger pressure is applied against end 72 of latch 68 to bias the end 74 away from the latch portion 94 (later described) of shroud 18, another finger can be used to grip cable support 46 to permit added leverage to be exerted against latch 68.

Figure 8:
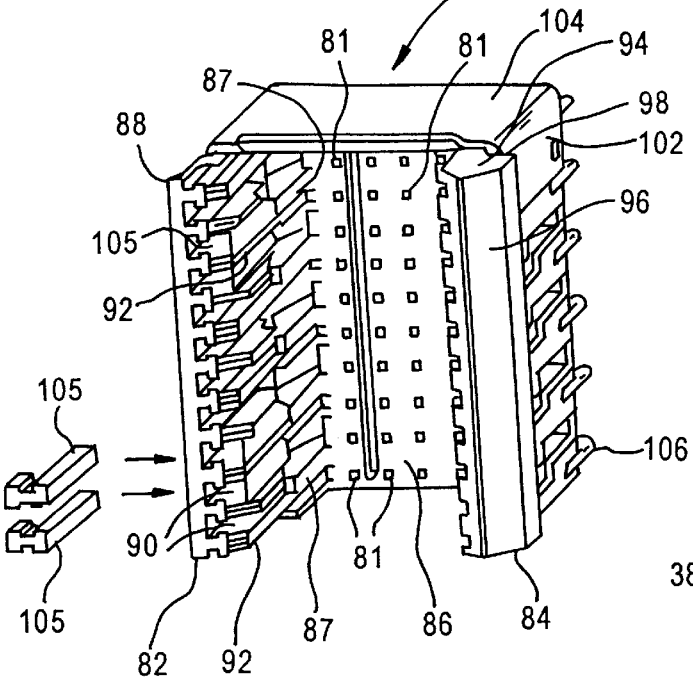
FIG. 8 is a top view of a pin shroud.
Figure 9:
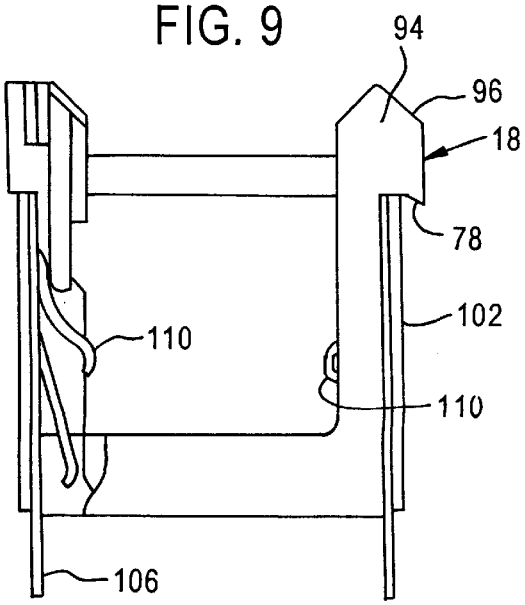
FIG. 9 is an end view of a pin shroud showing means for shielding the pin shroud from electromagnetic interference.

Pin shroud 18 is generally molded in a rectangular shape from plastic, for example from PBT. FIGS. 8 and 9 show that pin shroud 18 includes elongated side walls 82 and 84 and a base 86. Preferably the base 86 has multiple apertures 81 arranged in a field of rows and columns through which may pass pins 21 connecting the cable socket connector 12 to electrical circuits contained on the back plane 20. Wall 82 includes an upper portion 88 which is preferably molded integral with wall 82. Wall 82 further includes a plurality of channels 90 (see FIGS. 1A and 8) which extend vertically along wall 82 between adjacent ribs 92. The upper ends of ribs 92 are preferably tapered to facilitate entry of keys 66 into channels 90. Channels 90 terminate at the lower portion of wall 82 in pillars 87. Wall 84 of pin shroud 18 also includes a set of channels and ribs, 90 and 92, respectively, which are complementary to those contained in wall 82. Channels 90 within pin shroud 18 may each selectively receive a corresponding key 66 on hood 44 in a manner which will be later described. Keys 66 are located on wall 50 of hood 44 to insure that the keys 66 engage channels 90 in pin shroud 18 before any of the pins 21 in pin shroud 18 make electrical contact with respective insulation displacement contacts 32 of cable socket connector 12. Thus, if cable socket connector 12 is improperly placed in the wrong location within pin shroud 18, the partitioning keys 105 contained in channels 90 will prevent entry of the guides 66 into channels 90, thereby insuring that an electrical contact is not made between pins 21 and the contacts 32 of cable socket connector 12. Pin shroud 18 may contain more or less than six rows of pins 21 and the length of side walls 82 and 84 will depend on the total number of pins contained in the rows of pins contained within pin shroud 18. Furthermore, it should be apparent that a variety of types of pins can be used in conjunction with pin shroud 18, for example electrical connector pins sold by the Winchester Electronics Division of Litton Systems, Inc. under the trademark C-Press®. The configuration of the pin end 34 of insulation displacement contact 32 is chosen to accommodate the shape of the pins 21 contained in pin shroud 18 so that a low resistance electrical connection is made between the pins and the contacts.

FIG. 9 shows that wall 84 also includes latch portion 94 at its upper portion. Latch portion 94 includes a sloped face 96 and shelf 78. Latch portion 94 constitutes a latch receiving means to receive latch 68 to firmly engage and retain cable socket connector 12 within pin shroud 18.

Figure 10:
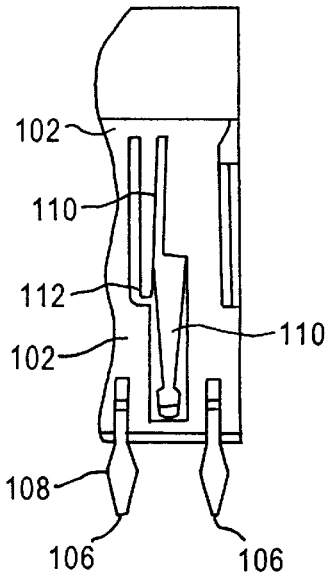
FIG. 10 is a side view of a portion of the shielding means for shielding the pin shroud from electromagnetic interference.

In a preferred embodiment, pin shroud 18 may also include a pin shroud shield means to prevent electromagnetic interference and/or radio frequency interference from adversely affecting signals transmitted between cable 14 and pins 21. Pin shroud shield means 100 includes electrically conductive side shielding 102 on sides 82 and 84 of pin shroud 18 and end shielding 104 on both ends of pin shroud 18. As is best shown in FIG. 10, side shielding 102 includes at its lower extremity a plurality of pins 106 made of an electrically conductive material which include expanded, resilient sections 108 which may be received in apertures (not shown) in the back plane 20 to effect a low resistance electrical connection between shield 100 and a ground plane (not shown) contained on the back plane 20. Side shield 102 includes a plurality of side shield beams 110 which are formed as spring like members integral with side shield 102. Preferably, the material is sufficiently resilient so that when the side shield beams 110 have been formed into fingers, they have a spring like quality to permit them to make low resistance electrical connections between each side shield 102 and hood 44 which has been plated with an electrically conductive plating. Preferably, side shield beams 110 each pass through apertures 112 in side walls 82 and 84 to effect electrical connections between pin shroud shield 100 and hood 44 of cable socket connector 12. Side shields 102 may be manufactured from a spring steel or other conductive, resilient material, for example a copper-beryllium alloy so that side shield beams 110 provide mechanical resistance to the placement of the cable socket connector 12 into pin shroud 18, thereby insuring a low electrical resistance path between hood 44 and the ground plane contained on back plane 20. While the foregoing arrangement of shielding has been described as including a metallic shielding which is separately added to the pin shroud 18, it is also possible to mold pin shroud 18 with integral end shielding walls 104, ground shield pins 106 and side shield beams 110 from a non-conductive plastic, for example, PBT. Thereafter, the pin shroud 18 (including end walls 104) and corresponding pins 106 and side shield beams 110 may be selectively plated on its exterior surface with a conductive material such as aluminum to provide isolation against electromagnetic interference without the need to add separate pin shroud shield means 100 to the pin shroud 18.

Additional electrical noise suppression may be achieved by adding an electrically conductive coating to the exterior of the hood 44. Preferably, the exterior surfaces of hood 44 are coated with an electrically conductive coating using any of several well-known methods. While sufficient electrical shielding may be achieved by the combination of the shielding 100 and shielding on hood 44, additional shielding may be achieved by also coating 45 (see FIG. 4) the exterior surfaces of each wafer 22 with an electrically conductive coating. For example, each wafer 22 may also be made conductive in the same manner as the hood by carefully applying a coating of vacuum deposited aluminum to the exterior surfaces of each wafer 22, being sure to avoid placing the coating on the interior surfaces of the wafer which, might jeopardize the electrical isolation of signals carried by adjacent insulation displacement contacts 32. Coating 45 can be applied to the entire exterior of wafer 22 including the exterior surface of the wafer cover plate 26. The conductive coating on each wafer 22 makes contact with the conductive coating on hood 44 at least by means of the contact between each keying block 62 and the body of hood 44. Hood 44 and wafers 22 are grounded via contact between the hood 44 and the side shield beams 110 which wipe against the conductive coating on hood 44 when the cable socket connector 12 is inserted into the pin shroud 18. The arrangement of placing an electrically conducted coating on each wafer has the further advantage of isolating adjacent rows of contacts 32 from cross-talk which might be produced by the signal of one contact 32 being propagated into a circuit connected to a contact 32 in another, adjacent wafer. Thus, not only are all of the contacts in cable socket connector 12 protected against electromagnetic radiation through the coating on exterior of hood 44, but, additionally, additional isolation against stray electromagnetic radiation is provided by the conductive coatings placed on each wafer 22.

In still another preferred embodiment, means are provided to insure that cable socket connector 12 is inserted into the proper location in pin shroud 18 to insure that the proper set of pins 21 are engaged with the proper contacts 32 in connector 12. The foregoing is achieved by selectively keying the cable socket connector 12 and the respective portion of the pin shroud 18 by molding the proper combination of keys 66 into hood 44 for each cable socket connector 12 and by selectively blocking channels 90 of wall 82 in pin shroud 18 to prevent an improper cable socket connector 12 (that is, a hood having an improper set of keys 66) from entering any section of pin shroud 18 other than the portion containing the pins 21 to which the wires 16 of the desired cable socket connector 12 are intended to be connected. For example, FIG. 8 shows that one or more partitioning keys 105 may be inserted into selected channels 90 of wall 82 to prevent a cable socket connector 12 from entering into that portion of the pin shroud 18 by preventing the keys 66 on hood 44 from engaging channels 90. Keys 66 may enter those channels 90 which do not include partitioning keys 105. Furthermore, it should be noted that the insertion of the cable socket connector 12 into the pin shroud 18 is assisted by the rounded portion 67 of keys 66 which act as guides to insure proper axial alignment of the cable socket connector 12 prior to entering pin shroud 18, thereby further insuring that insulation displacement contacts 32 are properly aligned with pins 21 prior to the pins 21 being received within wafers 22 of the cable socket connector 12. Thus, pin shroud 18 and cable socket connector 12 can be effectively keyed to prevent a cable socket connector 12 from being installed into the incorrect portion of pin shroud 18.

The keying arrangement just described can also be used to insure that cable socket connectors 12 having different numbers of wafers 22 are installed in the proper location in pin shroud 18 by insuring that each hood 44 contains a unique number and/or location of keys 66 and that the pin shroud has been configured with a mating arrangement of keys 105 in channels 90 so that the appropriate cable socket connectors 12 can be installed only in the desired location in pin shroud 18.

As is evident from the foregoing detailed description of the preferred embodiments, many modifications can be made to the invention without departing from the spirit and scope of the invention. For example, while a conductive coating has been described for application to the hood 44 and wafers 22, it is also possible to utilize a conductive foil-like material applied to the exterior surfaces of wafers 22 and hood 44 to effect the shielding. Similarly, other arrangements of latching mechanisms can be used to effect latching of the cable socket connectors 12 into a pin shroud 18. Thus, it is not intended to limit the invention to the detailed description herein recited, rather, the scope of the invention should be interpreted by the claims which follow.

We claim:

1. An electrical shielded cable connector for connecting a plurality of electrical signal-carrying wires to a printed circuit board having electrical circuits and a ground circuit, said shielded cable connector comprising:

a shielded pin shroud fastenable to the printed circuit board and including a plurality of electrically conducting pins passing therethrough to make contact with the circuits on the printed circuit board, said pin shroud including electrically conductive coating on exterior surfaces thereof and being electrically connectable to the ground circuit on the printed circuit board;

a shielded cable socket connector including a plurality of discrete wafers each including two or more insulation displacement contacts for making electrical and mechanical contact between the electrical signal-carrying wires in the circuits on the printed circuit board, each of said wafers further including an electrically conductive coating to shield the circuits from electromagnetic interference;

a hood having outer surfaces, said hood retaining said discrete wafers in said cable socket connector and having an electrically conductive coating on said outer surfaces;

each of said wafers having multiple insulation displacement contacts to engage said pins in said pin shroud when said cable socket connector is inserted into said pin shroud, the electrically conductive coating on said wafers making electrical contact with the electrically conductive coating on said hood when said wafers are retained in said hood; and said electrically conductive coating on said hood and said electrically conductive coating on said wafers being electrically connected to the electrically conductive coating on said pin shroud;

the electrically conductive coating on said hood and said electrically conductive coating on said wafers being electrically grounded to the ground circuit on the printed circuit board when said cable socket connector is inserted in said pin shroud;

wherein the pin shroud is capable of retaining more wafers than said cable socket connector, wherein each of said wafers has a wafer cover plate on one side of said wafer.

2. The electrical shielded cable connector of claim 1 wherein said hood includes a plurality of keyed apertures to retain a latch for latching said cable socket connector to said pin shroud.

3. The electrical shielded cable connector of claim 1 further including a latch which includes a latch engaging portion having a sloped guide at a distal end and said pin shroud includes a latch engaging shelf to receivably engage the latch engaging portion of said latch, whereby said cable socket connector is firmly attached to said pin shroud when the latch engaging portion of said latch is engaged by the latch engaging shelf of said pin shroud.

4. The electrical shielded cable connector of claim 1, wherein the electrically conductive coating on said pin shroud is electrically connected at multiple locations to the ground circuit on said printed circuit board.

5. The electrical shielded cable connector of claim 1 wherein the electrically conductive coating on said wafers and on said hood is comprised of a conductive layer of aluminum on the outer surfaces of said hood and each of said wafers.

6. The electrical shielded cable connector of claim 1 further including latch receiving means on said pin shroud, said latch receiving means on said pin shroud receiving said latch on said cable socket connector to retain the cable socket connector to said pin shroud.

7. The electrical shielded cable connector of claim 6 wherein said pin shroud and said cable socket connector include means for permitting said cable socket connector to he selectively received in said pin shroud to control the connection of selected ones of the electrical conductors to selected pins contained in said pin shroud.

8. The electrical shielded cable connector of claim 7 wherein the means for permitting said cable socket connector to be selectively received in said pin shroud include channels on at least one of the elongated parallel walls of said pin shroud and corresponding, mating keys on at least one wall of the hood of said cable socket connector.

9. The electrical shielded cable connector of claim 7 further including means on said keys to direct said keys into corresponding channels of said pin shroud.

10. The electrical shielded cable connector of claim 1, further including a latch that is pivotably mounted on said cable socket connector to engage said pin shroud.

11. The electrical shielded cable connector of claim 10, wherein said pin shroud includes a shoulder engageable with said latch.

12. The electrical shielded cable connector of claim 10, wherein said cable socket connector includes at least one aperture and said latch includes a corresponding at least one mounting portion for engaging a corresponding said aperture.

13. The electrical shielded cable connector of claim 10, wherein said latch includes a finger biased portion and a distal latching portion.

14. The electrical shielded cable connector of claim 1, wherein said pin shroud includes opposed keyways and said cable connector includes opposed keys mateable with said opposed keyways and further comprising a positioning key insertable into one of the keyways for controlling the location in which said cable socket connector may be inserted into said pin shroud.

15. The electrical shielded cable connector of claim 1, further comprising a wafer cover plate mechanically fastened to said wafer.

16. The electrical shielded cable connector of claim 1, wherein said hood includes a plurality of apertures and each of said wafers includes a tab engageable with a corresponding aperture.

17. The electrical shielded cable connector of claim 1, further comprising resilient members extendable from said electrically conductive material into a ground circuit in the printed circuit board.

18. The electrical shielded cable connector of claim 17, wherein said electrically conductive material includes side shield beams to effect an electrical connector between said cable socket connector and said pin shroud.

* * * * *